US005752582A

United States Patent [19]

Hayward

[11] Patent Number: 5,752,582

[45] Date of Patent: May 19, 1998

[54] SELF-SERVICE CHECKOUT SYSTEM

[75] Inventor: Jonathan W. Hayward, Doylestown, Pa.

[73] Assignee: Stores Automated Systems, Inc., Bristol, Pa.

[21] Appl. No.: 599,222

[22] Filed: Feb. 9, 1996

[51] Int. Cl.[6] ..... A47F 9/04

[52] U.S. Cl. ..... 186/61; 186/66; 186/68

[58] Field of Search ..... 186/59, 60, 61, 186/62, 63, 64, 65, 66, 67, 68, 69; 235/383

[56] References Cited

U.S. PATENT DOCUMENTS

| | | | |
|---|---|---|---|
| 3,878,365 | 4/1975 | Schwartz . | |
| 3,899,775 | 8/1975 | Larsen . | |
| 4,114,727 | 9/1978 | Joseloff . | |
| 4,676,343 | 6/1987 | Humble et al. | 186/61 |
| 4,779,706 | 10/1988 | Mergenthaler | 186/61 |
| 4,940,116 | 7/1990 | O'Connor et al. | 186/61 |
| 5,013,896 | 5/1991 | Ono et al. | 235/381 |
| 5,083,638 | 1/1992 | Schneider | 186/61 |
| 5,123,494 | 6/1992 | Schneider | 177/50 |
| 5,168,961 | 12/1992 | Schneider | 186/61 X |
| 5,216,502 | 6/1993 | Katz | 358/108 |
| 5,239,165 | 8/1993 | Novak | 235/375 |
| 5,256,863 | 10/1993 | Ferguson et al. | 235/383 |
| 5,277,453 | 1/1994 | Patel | 283/70 X |
| 5,353,219 | 10/1994 | Mueller et al. | 364/405 |
| 5,434,394 | 7/1995 | Roach et al. | 235/375 |

*Primary Examiner*—F. J. Bartuska

*Attorney, Agent, or Firm*—Panitch Schwarze Jacobs & Nadel, P.C.

[57] ABSTRACT

An automated checkout station is provided which allows a single cashier to monitor and assist multiple customers simultaneously without the requirement for a video surveillance system. The automated checkout station includes all of the features necessary for a customer to complete a transaction, such as a scanner, a bagging assembly, a customer display, a printer and an electronic payment system. However, the height of the station and the layout of plural stations allows a single cashier to easily interact with customers.

21 Claims, 3 Drawing Sheets

SELF-SERVICE CHECKOUT SYSTEM

FIELD OF THE INVENTION

The present invention relates generally to checkout systems and, more particularly, to an automated checkout station layout comprising two or more automated checkout stations surrounding a cashier.

BACKGROUND OF THE INVENTION

Briefly, the present invention is directed to an improved automated checkout station and station layout for retail stores, such as supermarkets.

Automated checkout stations or point-of-sale systems are generally known, although not yet in widespread common usage. Generally, such systems comprise a scanner/scale located at a starting end of a conveyor belt, a display device for displaying item information, and a bagging station located at a finishing end of the conveyor belt. The conveyor belt moves the items through the system with the motion of the belt being controlled by the system. Items are moved into the scanner/scale area, where individual items are scanned and/or weighed. After an item has been scanned, the display shows an item description, price and sale total information. Subsequently, the item is placed on the belt, where it is moved to a bagging area, which is away from the customer. Some automated checkout systems also include an electronic payment system (EPS), or electronic funds transfer (EFT) device, such as an automated teller machine (ATM), which allows the customer to complete the transaction without the aid of a cashier.

Since no cashier is needed at an automated checkout station, complex video and sensor monitoring systems are included to prevent misuse by customers. The monitoring systems allow a supervisor or cashier located remotely from the station to monitor the use of the station. In these systems, a supervisor is often located at a podium or raised platform which allows the supervisor to monitor up to four stations simultaneously. If the system alerts the supervisor of misuse or fraud, the supervisor must leave the podium and walk over to the checkout station. Such automated stations also generally include a help button which notifies store personnel that customer assistance is required, again requiring store personnel to walk over to the station.

Video systems have also been used to perform remote SKU lookup and/or payment authorization, such as remote validation of a customer's identification, such as by reading a driver's license. However, such video systems are complex and often unreliable.

After all items have been scanned or otherwise entered into the system and bagged by the customer, if the customer is not able to pay using the EPS or the station is not equipped to accept payment, the customer goes to a separate cashier station to tender payment and present coupons. Although sometimes coupons can be scanned at the automated station, they generally must be tendered to the cashier. Often, a single cashier services several automated checkout stations.

For instance, U.S. Pat. No. 5,168,961 (Schneider) discloses providing six self-service checkout stations arranged as two parallel lines of three stations each, which are arranged parallel and adjacent to conventional checkout lanes. At the exit end of the two rows of self-serve checkout stations is a supervisor station equipped with a video display screen, a keypad and a cash drawer, and staffed with a supervisor. Carts leaving the checkout station area must pass in front of the supervisor station.

The present invention improves on the layout of the known prior art systems by placing the cashier between two or more automated stations so that the cashier can directly interact with the customers that need assistance. Because the cashier is located next to the customers, the video cameras located at each station are no longer necessary, nor is the television monitor at the podium. In addition, cash payments can be made directly to the cashier, as opposed to the often slower and more awkward method of using a cash machine to accept bills and coins. The elimination of video cameras and cash acceptors decreases the complexity and cost of the system. Further, the retail establishment need only employ a single cashier to manage a plurality of checkout stations.

SUMMARY OF THE INVENTION

Briefly stated, the present invention is a checkout system comprising at least two automated checkout stations each having a customer side and a cashier side and which are arranged in generally adjacent relationship with the customer side of each station facing outwardly thereby defining a central space for a cashier so that a single cashier is capable of monitoring and assisting transactions at each of the at least three checkout stations. That is, the at least three checkout stations substantially surround the cashier. Each automated checkout station includes a scanner, a bagging assembly, a customer display, a printer and an electronic payment system, so that a customer can checkout without the aid of the cashier.

BRIEF DESCRIPTION OF THE DRAWINGS

The foregoing summary, as well as the following description of preferred embodiments of the invention, will be better understood when read in conjunction with the appended drawings. For purposes of illustrating the invention, there are shown in the drawings embodiments which are presently preferred. However, the invention is not limited to the particular arrangements and instrumentalities disclosed. In the drawings.

DESCRIPTION OF PREFERRED EMBODIMENTS

Figure 1:
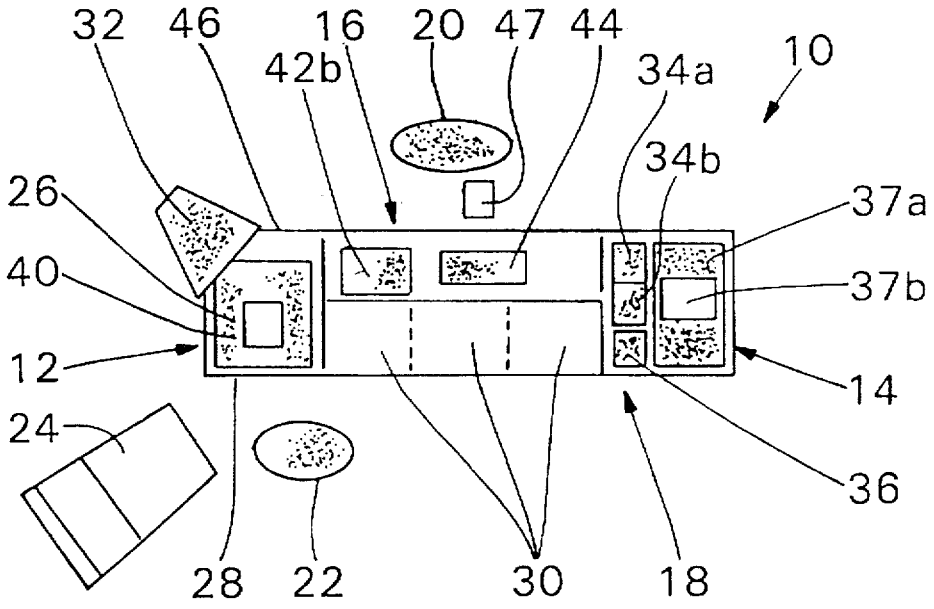
FIG. 1 is a top plan view of an automated checkout station in accordance with a preferred embodiment of the present invention.
Figure 2:
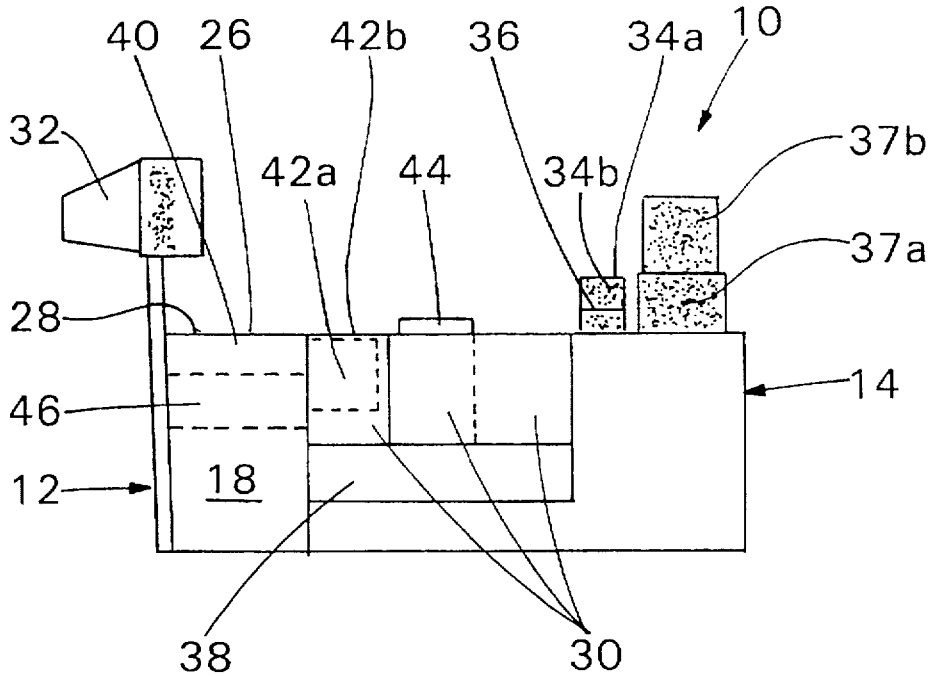
FIG. 2 is a side elevational view of the automated checkout station shown in FIG. 1.

Referring to the drawings, wherein like numerals are used for like elements throughout the several figures, there is shown in FIGS. 1–2 a preferred embodiment of an automated checkout station 10 for use in the present invention. The station 10 is generally for use in retail stores, such as supermarkets, drug stores, discount stores and the like, and allows a customer to purchase goods without the assistance of a cashier. The station 10 has an entry side 12, an exit side 14, a cashier side 16 and a customer side 18. A cashier 20 is positioned on the cashier side 16 of the station 10 and a customer 22 with a shopping cart 24 is indicated on the customer side 18. The station 10 also includes a scanner 26, such as a laser scanner for reading bar codes or universal price codes (UPC) associated with products which the customer 22 intends to purchase. Although a UPC-type scanner is the most common method of identifying the item to be purchased and inputting price information, the scanner 26 could read any type of optical character recognition (OCR) symbol, or bar code symbol used in a retail environment. Such symbol types include, but are not limited to OCR-A, OCR-B, code 3 of 9, code 128, codabar, and Plessy code.

The scanner 26 is located on a counter portion 28 of the station 10 proximate to the entry side 12. In the presently preferred embodiment, the counter portion 28 of the station 10 is designed to be between 2.5 to 4 feet high or about waist high for a typical customer in order allow the customer 22 to easily place products thereon. More preferably, the counter portion 28 is about 3 feet from ground level. Although the station 10 provides a physical barrier separating the customer 22 from the cashier 20, it is important that the counter portion 28 and the overall station 10 not be excessively high, ensuring that the customer 22 can easily interact with the cashier 20, if desired. Maintaining a line of sight between the customer 22 and the cashier 20 alleviates the fear of using an automated device, such as the station 10, in customers uncomfortable with or having an aversion to using such machines. The counter portion 28 maintains the scanner 26 and provides that items or merchandise moves directly from the shopping cart 24 to the scanner 28. Optionally, in order to accommodate a customer 22 not using a shopping cart 24, the counter portion 28 may be extended to provide a space for the customer 22 to place items prior to scanning those items having an associated bar code with the scanner 26.

The station 10 also includes at least one bagging assembly 30, a customer display 32, a printer **34*a*, 34*b* and an electronic payment system 36. The bagging assembly 30 includes a means for holding one or more bags, such as paper bags, or plastic bags having two handles formed on opposing sides, in an open position to thereby allow the customer 22 to place a product, which has been scanned, weighed or otherwise entered into the system 10, therein. The means for holding a bag (not shown) may comprise a pair of arms projecting upwardly from the counter portion 28 of the station 10 which receive and hold opposing sides of the bag so that the customer 22 can place scanned products into the bag. Such bag holders are known and generally commercially available. In the presently preferred embodiment, the bagging assembly 30 also includes a scale 38 located beneath the bagging assembly arms and beneath the counter portion 28 for weighing the contents of a bag into which a customer is placing products. Weighing the contents of the bag provides the station 10 with a means for verifying that each of the items placed in the bag has also been scanned using the scanner 26. That is, when a product is scanned, information associated with the product is retrieved into the station 10, such as price, description, product type, brand information, and package size and gross weight. The station 10 associates such information with the product, for instance by accessing a product-price lookup table. Since the weight of the product is known (and stored in the system, for instance in the look up table), this weight can be compared with the change determined using the weight measured by the bag assembly scale 38 when the product is placed in the bag. Thus, the bag assembly scale 38 and the bagging assembly 30 are combined such that the bag assembly scale 38 weighs the contents of a bag located thereon. In the presently preferred embodiment, the bagging assembly 30 is capable of holding in an open position and weighing the contents of two or more bags. As shown in FIGS. 1 and 2, preferably the bagging assembly 30** accommodates three open bags simultaneously.

The station 10 may also include a second or customer scale 40 on the counter portion 28 located proximate to the scanner 26, which is independent of the bagging assembly 30 and the bag assembly scale 38. The customer scale 40 can be used to weigh items which are typically priced based upon weight and are not prepackaged and/or labeled with a UPC, such as fruits and vegetables. Locating the customer scale 40 on the counter portion 28 of the station 10 proximate to the scanner 26 allows the customer 22 to quickly and easily weigh an item and then place the item in a bag. As is known by those of ordinary skill in the art, the customer scale 40 could also be integral with the scanner 26.

The customer display 32 allows the customer 22 to view transaction information, preferably in real-time. As item or product information is entered into the station 10, generally by either using the scale 40 or the scanner 26, the product information, as described above, is displayed on the customer display 32. In addition, other information can be displayed on the customer display 32, such as other information relevant to the sale (e.g. running total), discount or specials information, or other commercial information, such as advertisements, which may or may not be related to the present transaction. The customer display 32 can also be used to inform the customer 22 on how to proceed with the transaction, delete an item from the transaction, etc. The customer display 32 can also display live motion video to educate customers as to the use of the system and to attract customers to the system 10.

In the presently preferred embodiment the customer display 32 comprises a color monitor, such as a 14 inch VGA monitor. However, it will be understood that other display devices can be used, such as LED displays, LCD displays, monochrome monitors, etc. The customer display 32 is located proximate to the counter portion 28 of the station 10 and preferably is raised to approximately customer eye-level, which is generally between 4 and 6 feet from the ground. Preferably, the customer display 32 is also positioned or angled so that it is generally facing the customer 22 standing on the customer side 18 of the station 10, as shown in FIG. 1. However, if the customer display 32 is also used by the cashier 20, the customer display 32 will be positioned such that both the customer 22 and the cashier 20 are able to read the display 32. In the preferred embodiment, the customer display 32 is a touch screen capable of accepting information as well as displaying information. For instance, the customer 22 could enter PLUs and end the transaction using the touch screen. Such touch screens are known to those of ordinary skill in the art, and accordingly, need not be described in further detail. Alternately, a separate keypad for use by the customer 22 can be provided, preferably in close proximity to the customer display 32.

In the present embodiment, a separate cashier display **42*a* is provided for allowing the cashier 22 to readily view transaction information. Preferably, the cashier display 42*a* is positioned on the cashier side 16 of the station 10 opposite to the bagging assembly 30. More preferably, the cashier display 42*a* is located beneath the counter and is visible to the cashier 20 through a piece of glass 42*b* embedded flush with the counter top. The cashier display 42*a* can be a single or multiple line display, e.g. LCD or LED, or a video terminal, such as a color or monochrome monitor. The cashier display 42***a* can be the same as or different from the customer display 32 and can also display the same information as the customer display 32 or the cashier display 42*a* can show either additional or less information. For instance, if the customer display 32 displays instructions on how to continue or proceed with a transaction, this type of information might not be shown on the cashier display 42*a*. Also, commercial information, such as advertisements would not be shown on the cashier display 42*a*. However, additional pricing or discount information, or inventory information, not shown on the customer display 32 could be shown on the cashier display 42*a*.

The station 10 also preferably includes a keyboard or keypad 44, such as those typically associated with POS systems. The keypad 44 is used by the cashier 20 to input or enter information pertaining to the transaction, such as price overrides or product information for products which do not have a bar code or for which the scanner cannot read the bar code. The keypad 44 can also be used to execute commands, such as calculate sales tax and calculate totals. Optionally, a switch 47, such as a foot switch, is provided for enabling the keypad 44. The switch 47 prevents the customer 22 from accessing or executing cashier related functions, such as special discounts, when the cashier 20 is not present or is busy with another customer.

The printer 34*b* allows the customer 22 to obtain a receipt for the transaction. The printer 34*b* may comprise a slip printer of the type which are well known to those of ordinary skill in the art and commonly used with point-of-sale (POS) systems for printing receipts. Preferably, the station 10 also includes a check imprinter 34*a*, which prints transaction information, such as payee and amount information, on a check to facilitate customers who conduct business with a check. In the presently preferred embodiment, a separate receipt printer 34*b* and check imprinter 34*a* are used. However, the system 10 may also use a single combined receipt printer and check imprinter of a type commonly known to those of ordinary skill in the art.

The electronic payment system 36 allows the customer 22 to complete a transaction by paying for the goods. The electronic payment system 36 is of a type well known which accepts credit cards and debit cards. The electronic payment system 36 also accepts smart cards or integrated circuit cards. Optionally, the electronic payment system 36 includes either, or both a change dispenser 37*b* for accepting and dispensing change (i.e., coins) and a bill dispenser 37*a* for accepting and or dispensing bills. The electronic payment system 36 thus allows the customer 22 to complete a cash or check transaction completely unaided by the cashier 20 and in a minimum amount of time. However, the cashier 20 may be positioned on the cashier side 16 of the automated checkout station 10 to aid the customer 22 in conducting a transaction. The cashier 20 may also accept payment, as opposed to using the electronic payment system 36. Accordingly, the station 10 includes a cash drawer 46 for storing money and coupons. The cash drawer 46 is preferably located on the cashier side 16 of the automated checkout station 10.

The shape of the station 10 shown is generally rectangular. However, it will be understood by those of ordinary skill in the art that the station 10 could comprise other shapes, such as triangular or circular. Although not required, in the presently preferred embodiment, the customer 22 approaches the station 10 from the entry side 12, with the flow of a transaction moving from the entry side 12 towards the exit side 14.

The individual features of the automated checkout station 10, such as the scanner 26, the bag assembly scale 38, the bagging assembly 30, the printer 34, the electronic payment system 36 and the customer and cashier displays 32, 42*a* are all generally of a type well known to those of ordinary skill in the art and commercially available from a variety of manufacturers. Complete details of the structure and operation of each of these components are also known, and further description is not necessary for a complete understanding of the present invention. Suffice it to say that the station 10 allows the shopper or customer 22 to conduct a transaction, i.e. purchase goods, without the aid or assistance of the cashier 20. Also, as previously discussed, the height of the station 10 allows the customer 22 to interact with the cashier 20 if so desired or required.

Figure 4:
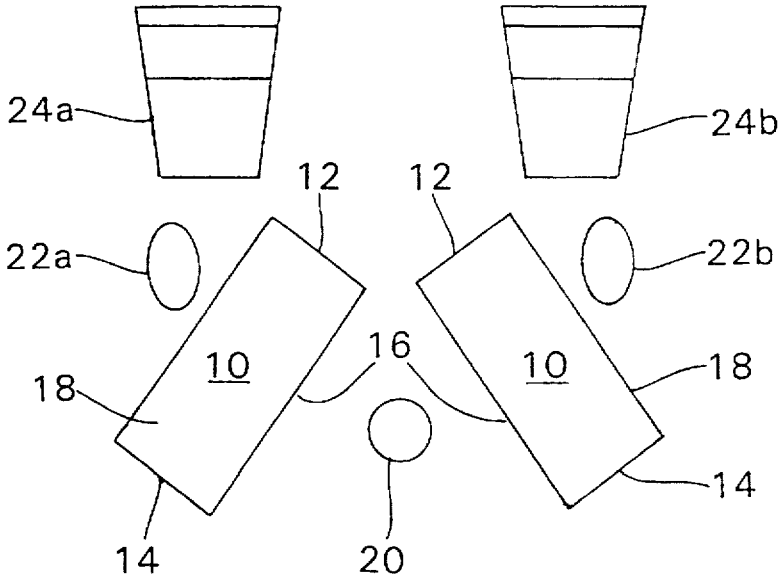
FIG. 4 is a top plan view of a two station configuration in accordance with a preferred embodiment of the present invention.

Referring now to FIG. 4, two automated checkout stations 10, two customers 22*a*, 22*b* having shopping carts 24, 24*b*, respectively, and a cashier 20 are shown. The automated checkout stations 10 are arranged such that the two customers 22*a*, 22*b* can simultaneously checkout and the cashier 20 can monitor each of the stations 10 and is available to aid either or both of the customers 22*a*, 22*b* in the checkout process. That is, the cashier 20 is positioned generally centrally with respect to the checkout stations 10 such that the cashier 20 is substantially surrounded by the automated checkout stations 10 at either station 10. The cashier 20 can directly interact with customers in need of assistance. Locating the cashier 20 next to the customers 22*a*, 22*b*, as opposed to locating the cashier 20 at a separate monitoring station remote from the automated checkout stations 10 alleviates the need for video cameras located at each station and a television monitor at a supervisory station. In addition, cash payments can be made directly to the cashier 20, as opposed to the often slower and more awkward method of using a cash machine which accept bills and coins. The checkout stations 10 are positioned such that the entry side 12 of the two stations 10 are adjacent to each other. In addition, the stations 10 are angled outwardly such that the exit sides 14 of the two stations are further apart from each other than the entry sides 12. This allows the cashier 20 to be more readily monitor the portion of the station where the customer unloads purchases from the shopping cart 24 onto the counter portion 28 of the station 10 and conducts the scanning and weighing operations.

Figure 3:
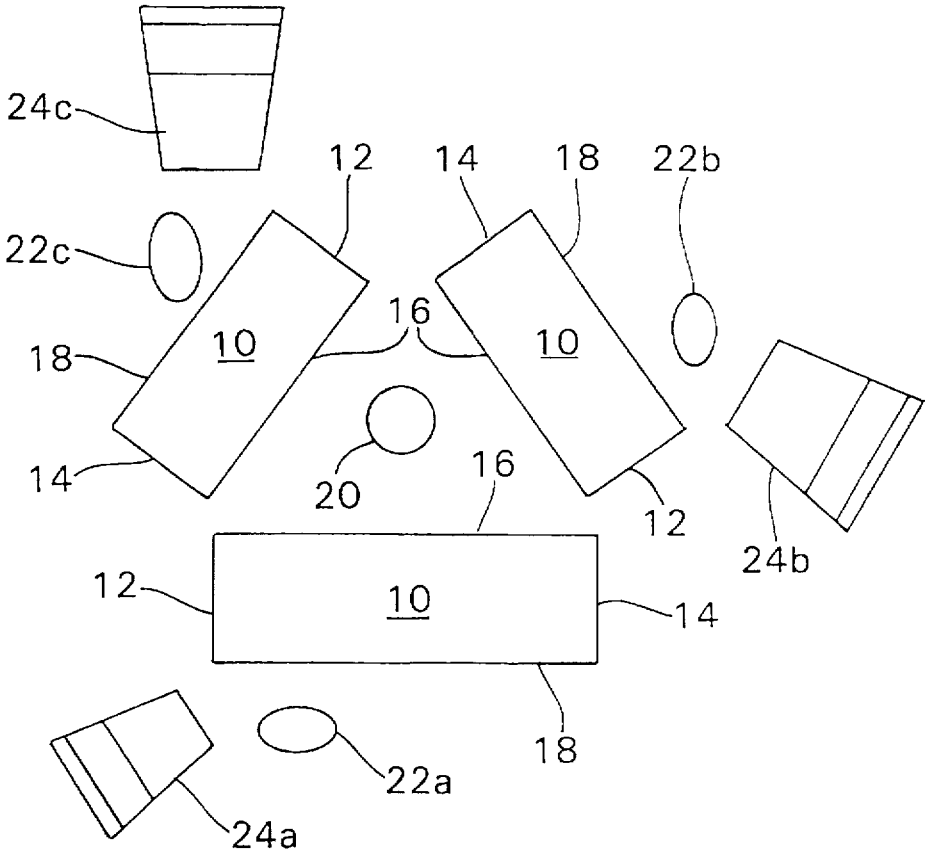
FIG. 3 is a top plan view of a three station configuration in accordance with a preferred embodiment of the present invention.
Figure 5:
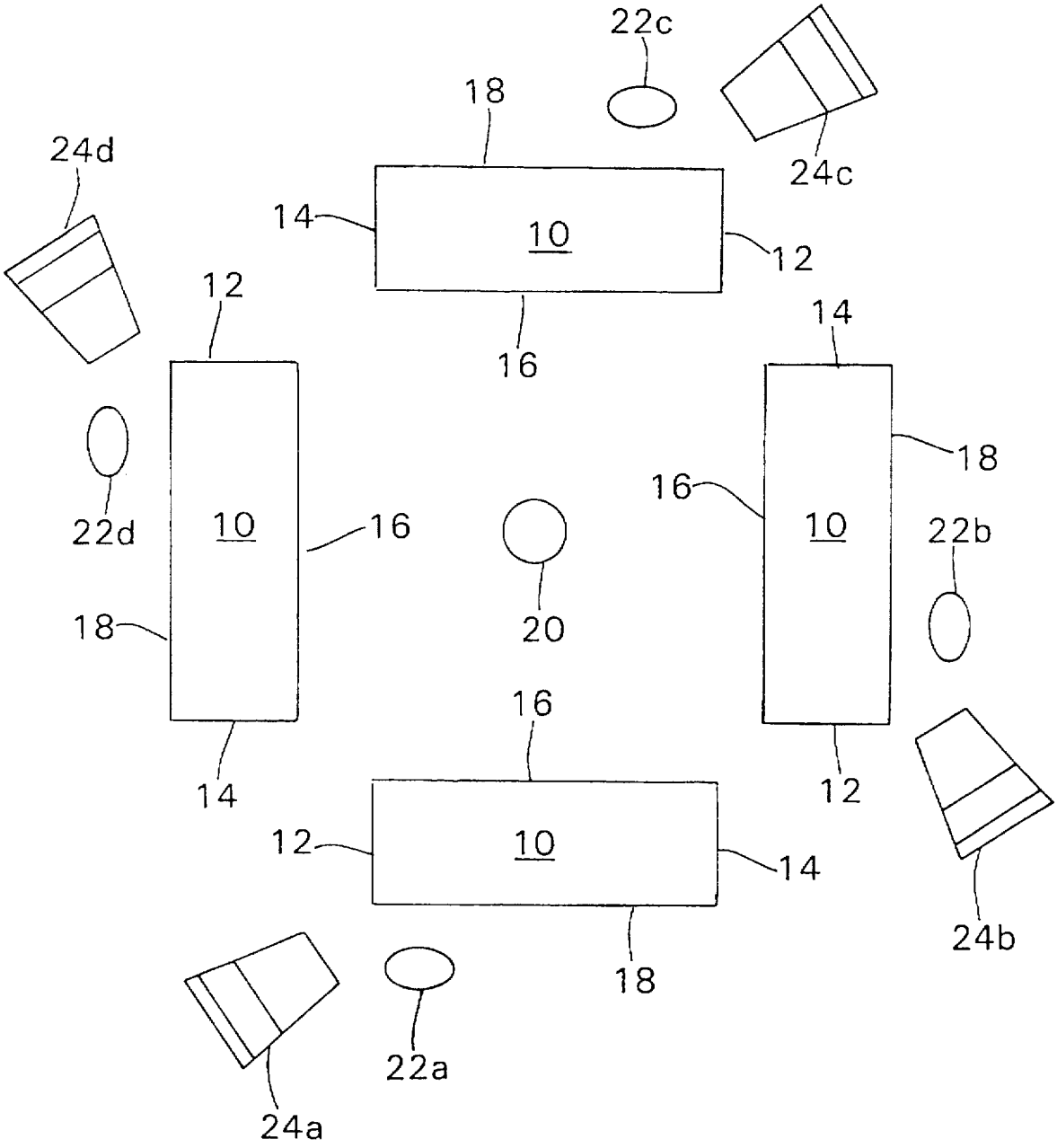
FIG. 5 is a top plan view of a four station configuration in accordance with a preferred embodiment of the present invention.

Referring now to FIG. 3, three automated checkout stations 10 are shown which are arranged in generally adjacent relationship to each other with the customer side 18 of each station 10 facing outwardly. The arrangement of the stations 10, such that the stations generally form a triangle, defines a central space for the cashier 20 so that the cashier 20 is capable of monitoring and assisting transactions at each of the three checkout stations 10. The three stations 10 are arranged such that the exit side 14 of one station 10 is located next to the entry side 12 of the adjacent station 10. FIG. 5 shows four automated checkout stations 10 arranged in accordance with the present invention. The four stations 10 generally circumscribe the cashier 20. As with the three station configuration, the stations 10 are arranged such that the entry side 12 of one station is proximate to the exit side 14 of the adjacent station. However, it will be apparent to those of ordinary skill in the art that the stations could be oriented such that two adjacent stations each have their entry ends 12 located proximate to each other.

From the foregoing description, it can be seen that the present invention comprises an automated checkout station and an arrangement therefore which allows a single cashier to monitor and aid two or more customers conduct a transaction. It will be recognized by those skilled in the art that changes may be made to the above-described embodiments of the invention without departing from the inventive concepts thereof. It is understood, therefore, that this invention is not limited to the particular embodiments disclosed but is intended to cover all modifications which are within the scope and spirit of the invention as defined by the appended claims.

I claim:

1. A checkout system comprising:

at least three automated checkout stations, each checkout station having a customer side and a cashier side and each checkout station including a scanner, a bagging assembly, a customer display, a printer and an electronic payment system;

wherein the at least three checkout stations are arranged in generally adjacent relationship with the customer side of each station facing outwardly thereby defining a central space for a cashier so that a single cashier is capable of monitoring and assisting transactions at each of the at least three checkout stations.

2. The system as recited in claim 1 wherein each of the automated checkout stations further comprises a scale.

3. The system as recited in claim 2 wherein the scale and the bagging assembly of each of the automated checkout stations are combined such that the scale weighs the contents of a bag located thereon.

4. The system as recited in claim 3 wherein the bagging assembly of each of the automated checkout stations includes means for simultaneously holding in an open position and weighing the contents of two or more bags.

5. The system as recited in claim 1 wherein the automated checkout stations each further comprise a cashier video display screen.

6. The system as recited in claim 1 wherein the printer comprises a receipt printer.

7. The system as recited in claim 6 wherein the printer further comprises a check imprinter.

8. The system as recited in claim 1 wherein the electronic payment system accepts debit cards, credit cards, and integrated circuit cards.

9. The system as recited in claim 1 the automated checkout stations each include a bill and change dispenser.

10. The system as recited in claim 1 wherein the automated checkout stations each further comprise a keyboard for facilitating a transaction.

11. The system as recited in claim 10 further comprising a switch located on the cashier side of the checkout station for enabling the keyboard, whereby the switch prevents a customer from operating the keyboard.

12. The system as recited in claim 1 the automated checkout stations each further comprise a cash drawer for storing money and coupons.

13. The system as recited in claim 12 wherein the cash drawer is located on the cashier side of the automated checkout station.

14. The system as recited in claim 1 wherein each of the automated checkout stations has a height of less than four feet.

15. The system as recited in claim 1 comprising four automated checkout stations.

16. A checkout system comprising:

at least three automated checkout stations, each checkout station having a customer side and a cashier side and each checkout station including a scanner, a bagging assembly, a customer display, a printer and an electronic payment system;

wherein the at least three checkout stations are arranged in generally adjacent relationship with the customer side of each station facing outwardly such that the checkout stations define a central space for a cashier, whereby the cashier is generally surrounded by the checkout stations so that the cashier is capable of monitoring and assisting transactions at each of the at least three stations.

17. The system as recited in claim 16 wherein each of the automated checkout stations has a height of less than four feet.

18. The system as recited in claim 17 wherein each of the automated checkout stations further comprises a scale.

19. The system as recited in claim 18 wherein the scale and the bagging assembly of each of the automated checkout stations are combined such that the scale weighs the contents of a bag located thereon.

20. The system as recited in claim 19 wherein the electronic payment system of each of the automated checkout stations accepts credit cards, debit cards and integrated circuit cards and prints a customer transaction receipt.

21. The system as recited in claim 20 wherein the automated checkout stations each further comprise a keyboard for facilitating a transaction and a switch located on the cashier side of the checkout station for enabling the keyboard, whereby the switch prevents a customer from operating the keyboard.

* * * * *